US010167174B2

(12) United States Patent
Molteni

(10) Patent No.: US 10,167,174 B2
(45) Date of Patent: Jan. 1, 2019

(54) ELECTROMAGNETIC LIFTER FOR HOT MATERIALS

(71) Applicant: SGM GANTRY S.P.A., Manerbio (BS) (IT)

(72) Inventor: Danilo Molteni, Manerbio (IT)

(73) Assignee: SGM MAGNETICS S.P.A., Manerbio (BS) (IT)

( * ) Notice: Subject to any disclaimer, the term of this patent is extended or adjusted under 35 U.S.C. 154(b) by 158 days.

(21) Appl. No.: 15/314,356

(22) PCT Filed: Jun. 18, 2015

(86) PCT No.: PCT/IB2015/054598

§ 371 (c)(1),
(2) Date: Nov. 28, 2016

(87) PCT Pub. No.: WO2015/193837

PCT Pub. Date: Dec. 23, 2015

(65) Prior Publication Data

US 2018/0237272 A1 Aug. 23, 2018

(30) Foreign Application Priority Data

Jun. 20, 2014 (IT) ..... MI2014A1127

(51) Int. Cl.
*B66C 1/06* (2006.01)
*H01F 7/20* (2006.01)

(52) U.S. Cl.
CPC ..... *B66C 1/06* (2013.01); *H01F 7/206* (2013.01)

(58) Field of Classification Search
CPC ..... B25J 15/0608; B66C 1/04; B66C 1/06; B66F 9/182; H01F 7/0257; H01F 7/206
See application file for complete search history.

(56) References Cited

U.S. PATENT DOCUMENTS 7,049,919 B2 * 5/2006 Yamaki ..... H01F 7/0294 269/8
2006/0119119 A1 * 6/2006 Molteni ..... B66C 1/04 294/65.5

(Continued)

FOREIGN PATENT DOCUMENTS

FR 2616006 A1 12/1988
WO 9908293 A1 2/1999
WO 2014083469 A1 6/2014

OTHER PUBLICATIONS

International Search Report and Written Opinion for International Application No. PCT/IB2015/054598 (dated Aug. 11, 2015).

*Primary Examiner* — Stephen A Vu
(74) *Attorney, Agent, or Firm* — Lucas & Mercanti, LLP

(57) ABSTRACT

An electromagnetic lifter for moving hot materials includes a ferromagnetic yoke formed by a horizontal core and two vertical polarities, coils wound around the core and enclosed in a container, a non-magnetic baffle arranged between the vertical polarities and below the container at a distance of at least 40 mm to protect the container from heat radiated by the hot material. The electromagnetic lifter also includes a first space between the container and the plurality of vertical polarities that maintains a first predetermined distance between the container and the plurality of vertical polarities, a second space between the container and the core that maintains a second predetermined distance between the container and the core, and a third space between the container and the non-magnetic baffle that allows a convective flow of air. The electromagnetic lifter also includes side spacers disposed in the first space and top spacers disposed in the second space.

22 Claims, 7 Drawing Sheets

(56) References Cited

U.S. PATENT DOCUMENTS

2011/0140468 A1* 6/2011 Molteni ..... B66C 1/06
294/65.5
2012/0153650 A1* 6/2012 Molteni ..... B66C 1/06
294/65.5

* cited by examiner

PRIOR ART

ELECTROMAGNETIC LIFTER FOR HOT MATERIALS

CROSS-REFERENCE TO RELATED APPLICATIONS

This application is a 371 of PCT/IB2015/054598, filed Jun. 18, 2015, which claims the benefit of Italian Patent Application No. MI2014A001127, filed Jun. 20, 2014.

FIELD OF THE INVENTION

Background of the Invention

The present invention relates to magnetic lifters, and in particular to an electromagnetic lifter able to operate safely even on ferromagnetic materials at high temperature up to 600-700° C. such as billets, blooms, slabs and similar steel products.

It is known that the spontaneous magnetization in ferromagnetic materials does not take place if the temperature reaches a characteristic value of the material known as Curie temperature (CT), which for ferromagnetic steels is between 720° C. and 770° C. approximately. For an effective magnetization of a ferromagnetic steel it is therefore necessary that in the conditions of use its temperature is lower than the characteristic CT of the steel in question. In fact the increase of temperature in a ferromagnetic circuit corresponds to a decrease of its relative permeability, which goes down to zero upon reaching the CT, whereby the reluctance of the circuit tends to infinity and consequently the magnetic induction and the lifting force tend to zero.

The variations in permeability and consequently in the lifting force of an electromagnet that must move hot ferromagnetic materials are considerable in particular in the temperature range between 600° C. and 700° C., where the permeability decreases approximately from 75% to 40% and the force drops approximately from 55% to 18% (compared to the values at room temperature).

An electromagnet of known type for applications in the steel industry therefore has a general structure as that shown in FIG. 1, with a yoke made of mild steel with high magnetic permeability formed by a horizontal core a and two vertical magnetic polarities b. Wrapped around core a there is a container c of the coils d, which provide the magnetomotive force to the electromagnet and simultaneously generate heat by Joule effect. A baffle e of non-magnetic material, typically stainless steel, protects the bottom of container c from the heat radiated by the hot material to be moved f with the aid also of a layer g of insulating resin usually of 7-10 mm thickness.

A part of this heat by Joule effect and of the heat taken by radiation and conduction from the hot material to be moved f is dispersed through the walls of the upper portion of the container c of the coils, but also with such a structure the electromagnet can operate only for a limited time. In fact the heat brings in a few hours of activity the coils d to a temperature above 200° C., whereby the lift must be put to rest to cool it down in order to prevent significant damage to the coils and/or the insulating resin that encloses them inside container c.

SUMMARY OF THE INVENTION

The object of the present invention is therefore to provide an electromagnetic lifter which overcomes the above drawbacks. This object is achieved by means of an electromagnetic lifter provided with spacers between the coils container and the yoke as well as with a non-magnetic baffle spaced from said container, so as to create convective air currents lapping all the external walls of the container thus reducing the heating of the coils when the lifter operates on materials with high temperature up to 600-700° C. Other advantageous features are listed in the dependent claims.

The basic advantage of the present lifter is therefore its ability to operate safely and indefinitely since the temperature of the coils always remains below 180° C., given that the heat of the hot material to be lifted is transmitted by conduction to the electromagnet yoke but passes to the coils container substantially only through a convection mode. This limited heat transfer combined with the improved cooling of the container allows to maintain the coils in a temperature range in which there is no risk of damage and therefore there is no need to put to rest the lifter to allow it to cool down.

Another important advantage of the lifter according to the present invention is given by the maximum operating safety guaranteed, in the preferred embodiment, by the presence of control coils that detect the linked flux, and therefore the magnitude of the lifting force, to ensure that the safety standards are met.

BRIEF DESCRIPTION OF THE DRAWINGS

Further advantages and features of the lifter according to the present invention will become apparent to those skilled in the art from the following detailed description of three embodiments thereof, with reference to the accompanying drawings in which.

DETAILED DESCRIPTION OF THE INVENTION

Figure 1:
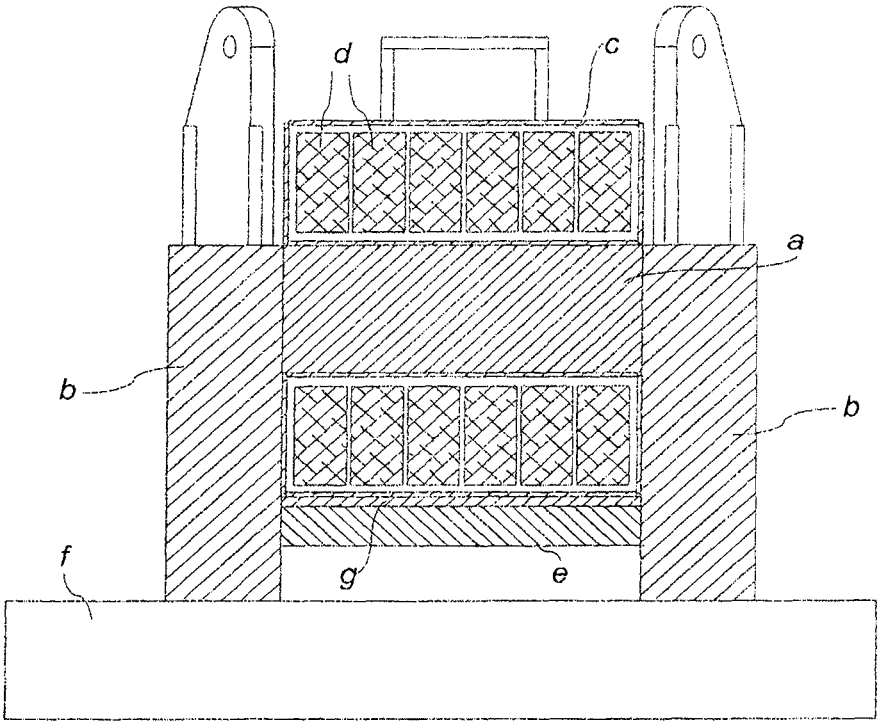
FIG. 1 is a cross-sectional view of a lifter of the prior art.
Figure 2:
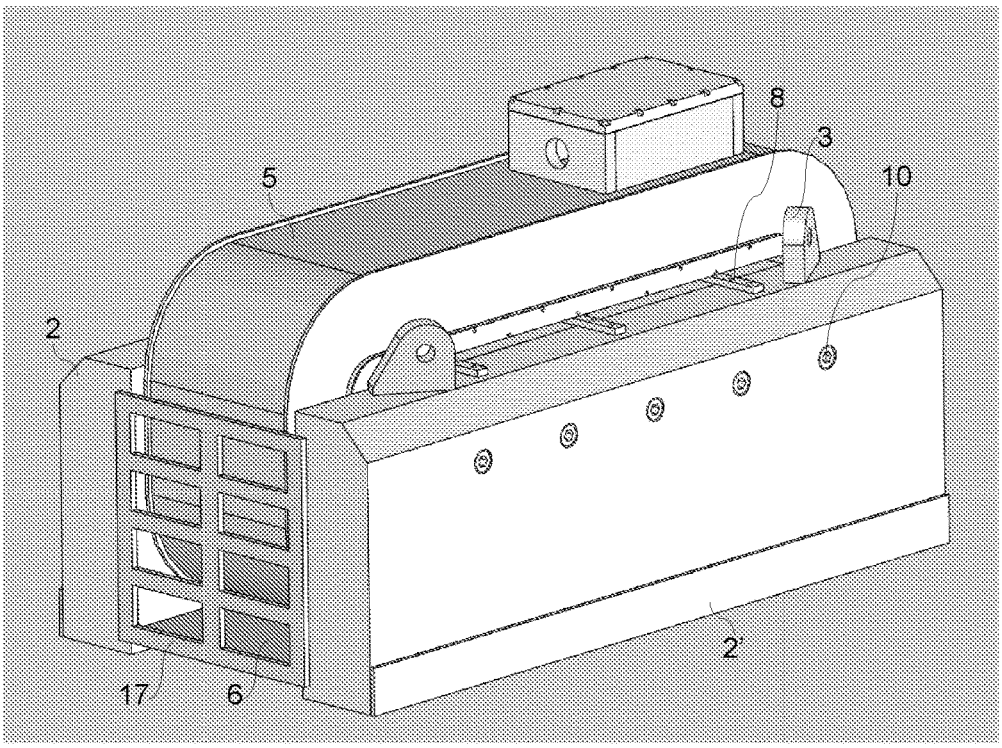
FIG. 2 is a top perspective view of a first embodiment of a lifter according to the invention.
Figure 3:
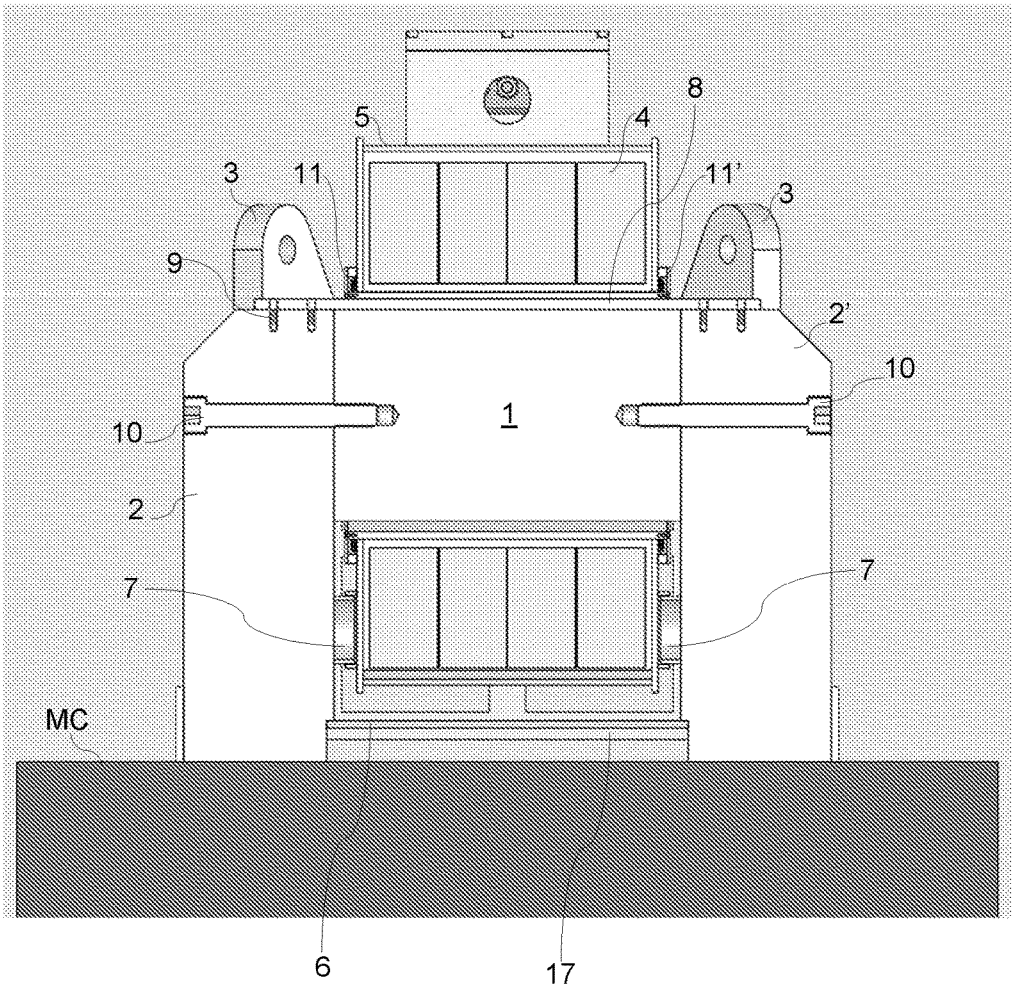
FIG. 3 is a cross-sectional view of the lifter of FIG. 2.
Figure 4:
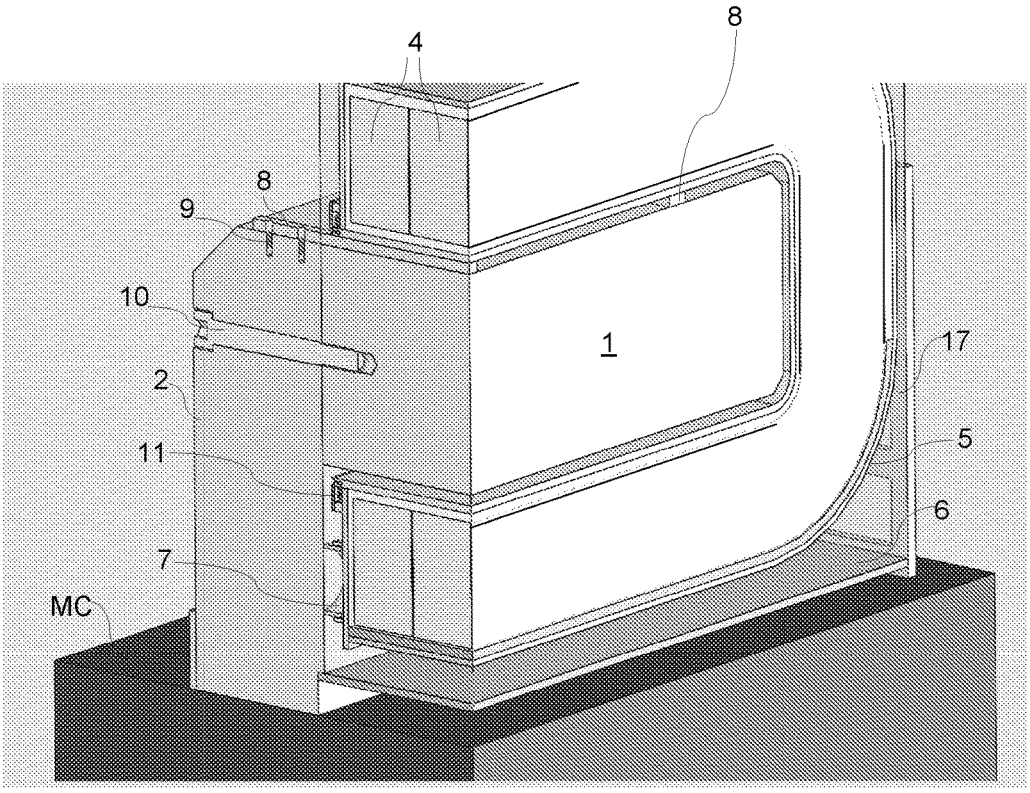
FIG. 4 is a partial perspective view of the section of FIG. 3 also cut in the longitudinal direction along the midplane.

Referring to FIGS. 2 to 4, there is seen that an electromagnetic lifter according to the present invention comprises in a known way a structure similar to that shown in FIG. 1, with a ferromagnetic yoke in the shape of an inverted U made up of a horizontal core 1 and two vertical polarities 2, 2' provided with connections 3 for attachment to lifting means (e.g. a crane), as well as lifting coils 4 wound around said core 1 and enclosed in a sealed container 5. Obviously, the yoke is made of materials with high magnetic conductivity, typically of mild carbon steel, to minimize the reluctance of the magnetic circuit.

A first novel aspect of this lifter resides in the fact that a non-magnetic baffle 6, preferably of stainless steel AISI 316L and intended to protect container 5 from the heat radiated by the hot material to be moved MC, is arranged between polarities 2, 2' in spaced relationship with container 5 rather than adjacent thereto as in prior art lifters, the distance between said elements 5, 6 being devoid of insulating resin and preferably of at least 30 mm. In this way, between baffle 6 and the bottom wall of container 5 there is formed a tunnel for the passage of air which induces the generation of a convective flow between the hot polarities 2, 2' so that the ambient air favors the cooling of container 5 and limits the heating of coils 4.

A second novel aspect of this lifter is given by the presence of side spacers 7 and top spacers 8 that keep container 5 away respectively from polarities 2, 2' and from core 1. These spacers 7, 8 are preferably dimensioned in such a way that between container 5 and the ferromagnetic yoke there is a space comprised between 10 and 25 mm, more preferably between 14 and 20 mm.

In this way, the passage of heat between the ferromagnetic yoke and the coils container occurs substantially only by convection, rather than by conduction as in prior art lifters, and the air can circulate around all the walls of container 5 thus improving the cooling thereof.

In order to minimize the "heat bridge" effect of spacers 7, 8 they are preferably made of heat-insulating material, e.g. glass-ceramic fiber, and have a section as small as possible. In particular, in the illustrated embodiment, the side spacers 7 have the form of rings of adequate height but reduced thickness inserted in corresponding seats formed on the side walls of container 5, while the top spacers 8 have the shape of thin rectangular rods which extend between polarities 2, 2' being fixed thereto by means of screws 9.

Note that other spacers similar to the top spacers 8 might be present also below core 1 but they would be of little use since it is sufficient that the inner ring of container 5 is adequately higher than core 1, given that the abutment on spacers 8 and the pressure exerted by the side spacers 7 already guarantee the positioning of container 5. It is therefore more advantageous that below core 1, where the temperature is higher than above it, there are no bottom spacers that would constitute further heat bridges and obstacles to the circulation of cooling air that rises along the sides of container 5 thanks to the space created by spacers 7.

FIGS. 2 to 4 also show how polarities 2, 2' are preferably fixed in a removable manner on core 1, for example by means of screws 10, to facilitate the possible maintenance or replacement of elements 4-7 enclosed in the ferromagnetic yoke. This solution is advantageous also to facilitate the production and assembly of the electromagnet with two identical polarities 2, 2', however it is clear that for an easy intervention on elements 4-7 it is sufficient that at least one of polarities 2, 2' is removable while the other one may be integral with core 1.

A third novel aspect of the lifter according to the present invention, in its preferred embodiment illustrated in the figures, consists in the presence of a control system that ensures the safe transport of the material to be moved, preferably a system of the type described in EP 2176871 whose contents are incorporated herein by reference. This system comprises a pair of control coils 11, 11' arranged so as to detect the linked flux, generated by the lifting coils 4, which passes in the ferromagnetic yoke and goes on to close the loop in the material to be lifted. Each coil 11, 11' is connected to a respective A/D converter which sends the digital data to a control unit whose purpose is to the grant or deny the authorization for transport, these elements being omitted in the figures.

Note that the control coils 11, 11' are preferably arranged to the sides of container 5 in a position adjacent to core 1 because in this area it is easier to protect them from mechanical and thermal stresses, however, these coils could be housed also in a symmetrical position along polarities 2, 2' respectively. In the illustrated position the control coils 11, 11' will also read part of any flux leakage from the sides, the value of which is not decisive since the effective value is monitored through the algorithms cited in the above-mentioned patent application.

This system allows to process one or more algorithms able to indicate with high accuracy the lifting force of the electromagnet based on the value of the detected linked flux. This ensures absolute safety during each maneuver of lifting and transport of the load, by checking that the decrease in the magnetic permeability of the ferromagnetic circuit of the lifter, and in particular of the hot material to be lifted MC, still allows the lifter to comply with the lifting safety coefficient according to the EN 13155 standard (or other similar standard in use in other countries). Otherwise an alarm signal is emitted and the lifting operation is blocked by repositioning the load on the ground.

In addition to the lifting force of the electromagnet, the control system also detects the dynamic aspects described in EP 2176871 with any imbalances between polarities 2 and 2' or excessive dynamism of the material in the case of moving packs of low thickness metal sheets, with gaps opening up between sheet and sheet upon starting the lift.

In the case of moving beds of billets, blooms etc. with only partial occupancy of the lifting surface of the electromagnet it is possible to introduce specific algorithms that take into account the number and position of the lifted elements. This is done by using lateral sensors such as those shown in the second embodiment illustrated in FIGS. 5 and 6, where on at least one of polarities 2, 2' there are arranged sensors 12, 12', . . . (e.g. optical, laser, infrared sensors, etc.) suitable to detect the number and position of the billets B. These data are then transmitted to a control unit which consequently selects the algorithm to be applied in the calculation, in case of automatic handling, or the operator selects the algorithm and sensors 12, 12' confirm the accuracy of the choice (the number of sensors and algorithms depends on the number of billets that can be lifted, e.g. two for 8 billets, three for 12 billets, etc.).

Figure 5:
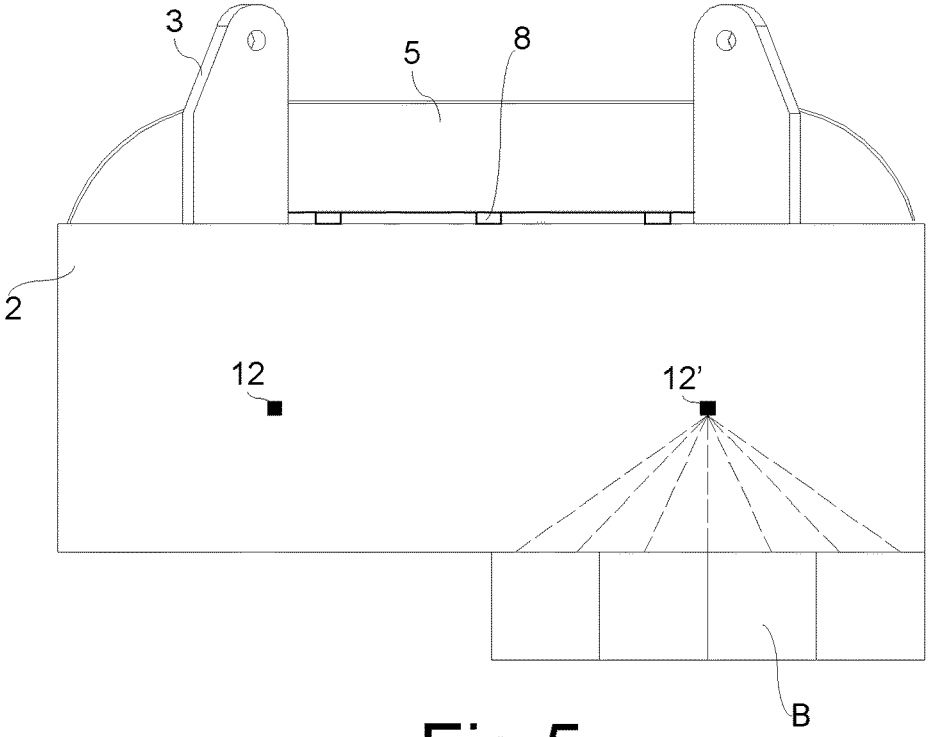
FIG. 5 is a schematic side view of a second embodiment of the lifter.
Figure 6:
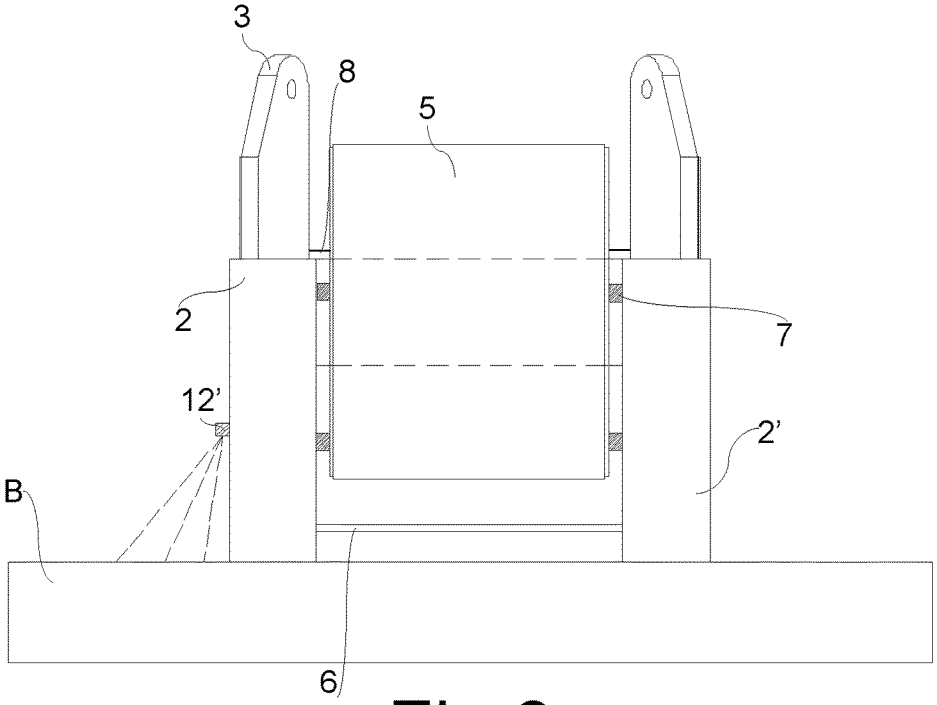
FIG. 6 is a schematic front view of the lifter of FIG. 5.

In this way the margin of error in the reading of the useful linked flux is reduced because while in the case of a bed of billets B that occupies the entire lifting surface the flux linked with the control coils (not shown) almost corresponds to the useful flux that is linked with the load, in the case of a partial bed as shown in FIG. 5 the flux linked with the control coils is higher than the useful flux but with the appropriate algorithm the margin of error is reduced.

An electromagnetic lifter thus constructed and operated is therefore able to safely move materials such as billets, blooms, slabs, etc. at a temperature of 600-700° C. and is suitable for operating cycles for the discharge of cooling plates located at the exit of the hot rolling of said products in a steel plant.

A further arrangement preferably applied in the lifter according to the present invention consists in differentiating the material used to insulate coils 4 placed inside the sealed container 5. In a conventional lifter the space between the coils and the container is filled with a material that achieves both a thermal and electrical insulation, i.e. a heat-insulating material with high dielectric strength such as a glass-ceramic fiber. In the present lifter such a material is instead used only in the portion of container 5 enclosed between polarities 2, 2' where coils 4 can receive heat from the ferromagnetic yoke and the load of hot material MC, while in the portion of container 5 above the yoke it is better to use resins that are electrically insulating but have a good thermal conductivity, e.g. silicone or epoxy resins loaded with quartz powder, to increase the outward transmission of the heat generated by the Joule effect.

Figure 7:
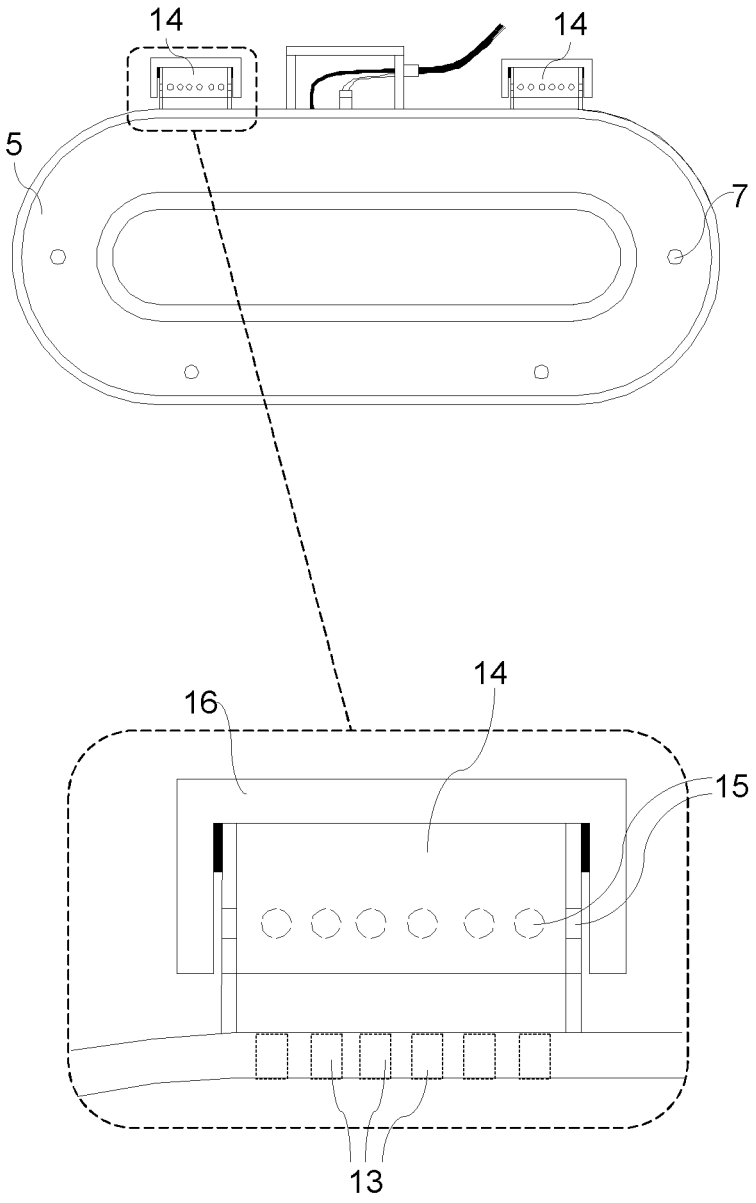
FIG. 7 is a schematic side view with an enlarged detail of a coils container of a third embodiment of the lifter.
Figure 8:
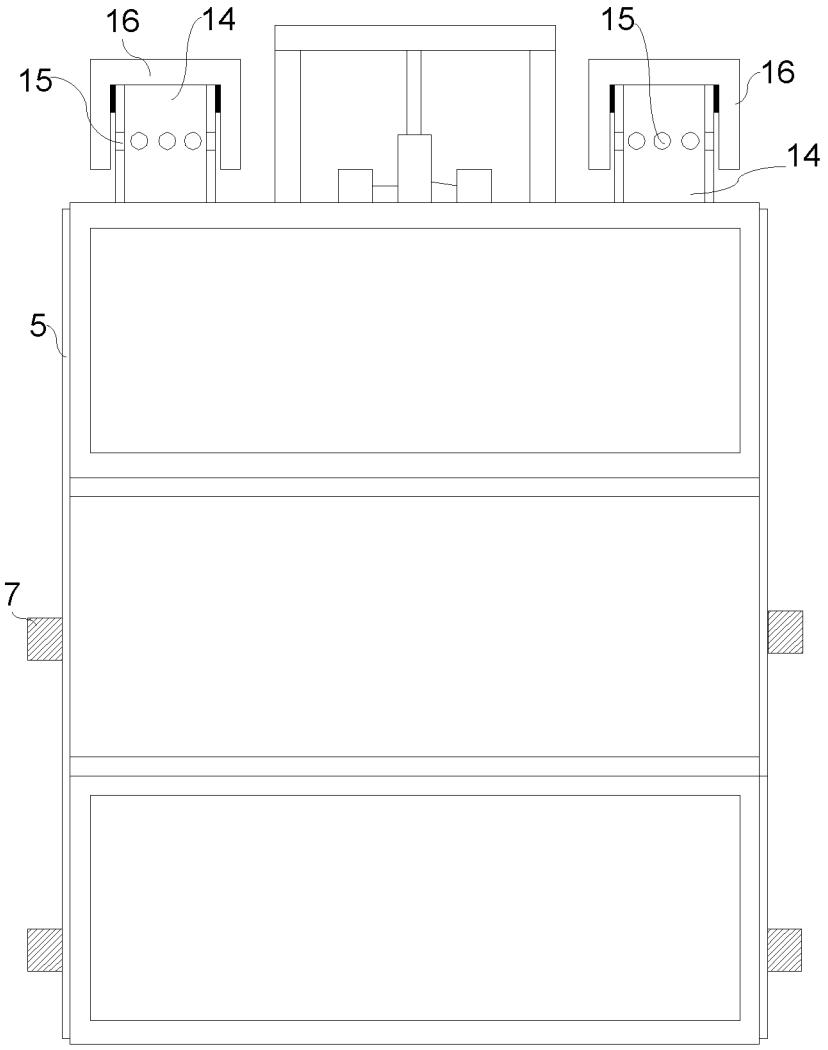
FIG. 8 is a schematic cross-sectional view of the container of FIG. 7.

A third embodiment of the present lifter, shown in FIGS. 7 and 8, is provided instead with a container 5 that is not sealed but in connection with the environment through grids of holes 13 (four grids in the example shown) formed in the top wall of container 5. Preferably, a labyrinth system is also used in order to prevent contact between coils 4 inside container 5 and the water or foreign bodies which might penetrate through holes 13. This system is realized by means of chimneys 14, arranged at holes 13, provided with lateral openings 15 and caps 16 that cover openings 15 yet are spaced therefrom.

This structure allows the change of air inside container 5 during operation in order to avoid the formation of condensation, whereby it is not necessary to provide insulating material between coils 4 and the walls of container 5 since air, if it is not rich in moisture, is already in itself a good thermal and electrical insulator. The coils, in this case, are only insulated externally and internally through spray painting with a waterproofing product which provides good resistance to chemical agents and corrosion, e.g. polyurea or other equivalents resins.

Finally, it should be noted that in order to facilitate the passage of air through this electromagnet it is preferably without heads or is provided with grid heads 17 that perform only a mechanical protection function (FIGS. 2-4).

Thanks to the innovative characteristics described above, the present lifter while moving material at temperatures of 600-700° C. and reaching in polarities 2, 2' temperatures of 650° C. in the grip area and 350° C. in the vicinity of core 1, which reaches temperatures of 300-350° C., will maintain the continuous operating temperature in the system of coils 4 to values below 180° C. suitable to work in safety from the electrical point of view.

It is obvious that the embodiments of the lifter according to the above-described and illustrated invention are just examples susceptible of various modifications. In particular, the exact number, shape and arrangement of the magnetic polarities may vary depending on the specific application, for example by providing a bipolar, tripolar, quadripolar lifter, etc. with two or more magnetic dipoles instead of only one magnetic dipole as illustrated in the present embodiments.

The invention claimed is:

1. An electromagnetic lifter for moving hot materials, comprising:

a ferromagnetic yoke formed by at least one horizontal core and a plurality of vertical polarities;

a plurality of coils wound around said at least one horizontal core and enclosed in a container;

a non-magnetic baffle arranged between the plurality of vertical polarities and below said container, the non-magnetic baffle adapted to protect the container from heat radiated by a hot material to be moved;

a first space between the container and the plurality of vertical polarities, the first space adapted to maintain a first predetermined distance between the container and the plurality of vertical polarities and to prevent contact between the container and the plurality of vertical polarities;

a second space between the container and the core, the second space adapted to maintain a second predetermined distance between the container and the core and to prevent contact between the container and the core;

a plurality of side spacers disposed in the first space between the container and the plurality of vertical polarities, the plurality of side spacers adapted to maintain the first predetermined distance between the container and the plurality of vertical polarities; and a plurality of top spacers disposed in the second space between the container and the core, the plurality of top spacers adapted to maintain the second predetermined distance between the container and the core.

2. The electromagnetic lifter according to claim 1, wherein the first predetermined distance and the second predetermined distance are between 10 and 25 mm.

3. The electromagnetic lifter according to claim 2, wherein the first predetermined distance and the second predetermined distance are between 14 and 20 mm.

4. The electromagnetic lifter according to claim 1, wherein the side spacers and top spacers are made from a thermally insulating material.

5. The electromagnetic lifter according to claim 4, wherein the thermally insulating material is glass-ceramic fiber.

6. The electromagnetic lifter according to claim 1, wherein the side spacers have a shape of rings of small thickness introduced in corresponding seats formed on side walls of the container.

7. The electromagnetic lifter according to claim 1, wherein the top spacers have a shape of rods extending across the vertical polarities and secured thereto.

8. The electromagnetic lifter according to claim 1, further comprising a third space between the container and the non-magnetic baffle, the third space adapted to form a tunnel for a passage of a convective flow of air.

9. The electromagnetic lifter according to claim 8, wherein:

a fourth space located within the container, in a first portion of the container enclosed between the vertical polarities, and between the coils and the container, is filled with a thermal insulator having a high dielectric strength; and a fifth space located within the container, in a second portion of the container above the yoke, and between the coils and the container, is filled with electrically insulating resins having a good thermal conductivity.

10. The electromagnetic lifter according to claim 9, wherein the thermal insulator is glass-ceramic fiber and the electrically insulating resins are silicone or epoxy resins loaded with quartz powders.

11. The electromagnetic lifter according to claim 8, wherein:

the container comprises a top wall having a plurality of holes, the container being in communication with an environment through the plurality of holes; and a fourth space located within the container, between the coils and the container, is empty.

12. The electromagnetic lifter according to claim 11, wherein the coils are externally and internally insulated through spray painting with a waterproofing product that provides a good resistance to chemical agents and corrosion.

13. The electromagnetic lifter according to claim 12, wherein the waterproofing product is polyurea.

14. The electromagnetic lifter according to claim 11, wherein a labyrinth system adapted to prevent penetration of water or foreign bodies into the container is disposed between the plurality of holes and the environment.

15. The electromagnetic lifter according to claim 14, wherein the labyrinth system includes:

chimneys arranged at the holes and provided with lateral openings; and caps that cover said lateral openings and are spaced therefrom.

16. The electromagnetic lifter according to claim 8, wherein the non-magnetic baffle is spaced from the container by at least 30 mm.

17. The electromagnetic lifter according to claim 1, further comprising a pair of control coils adapted to detect a linked magnetic flux that passes through the ferromagnetic yoke, each of said control coils being connected to a respective A/D converter that sends data relating to the detected magnetic flux to a control unit adapted to grant or deny authorization for transport of the hot material.

18. The electromagnetic lifter according to claim 17, wherein each of the control coils is disposed at a selected side of the container at a position adjacent to the core.

19. The electromagnetic lifter according to claim 17, further comprising a plurality of lateral sensors arranged on at least one of the vertical polarities and adapted to detect a number and position of elements in contact with a bottom face of said vertical polarities, the plurality of lateral sensors being operatively connected to the control unit.

20. The electromagnetic lifter according to claim 1, wherein at least one of the vertical polarities is removably secured to the core.

21. The electromagnetic lifter according to claim 20, wherein the at least one of the vertical polarities is secured on the core by screws.

22. The electromagnetic lifter according to claim 1, wherein the electromagnetic lifter has no heads or is provided with grid heads.

* * * * *